US007314111B2

(12) United States Patent
Matsumoto et al.

(10) Patent No.: US 7,314,111 B2
(45) Date of Patent: Jan. 1, 2008

(54) STARTER MOUNTING STRUCTURE

(75) Inventors: Shigehiro Matsumoto, Hadano (JP); Tatsuya Shiratori, Sagamihara (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 181 days.

(21) Appl. No.: 10/858,467

(22) Filed: Jun. 2, 2004

(65) Prior Publication Data

US 2004/0261742 A1 Dec. 30, 2004

(30) Foreign Application Priority Data

Jun. 4, 2003 (JP) ..... 2003-159196

(51) Int. Cl.
*F02N 11/00* (2006.01)

(52) U.S. Cl. ..... 180/292

(58) Field of Classification Search ..... 180/54.1, 180/291, 292; 123/179.25
See application file for complete search history.

(56) References Cited

U.S. PATENT DOCUMENTS

| | | | | | |
|---|---|---|---|---|---|
| 1,905,836 | A | * | 4/1933 | Gerald | 74/7 R |
| 3,598,093 | A | * | 8/1971 | Tanaka | 123/41.31 |
| 5,025,184 | A | * | 6/1991 | Sekine et al. | 310/71 |
| 5,207,195 | A | * | 5/1993 | McClintic | 123/179.25 |
| 5,501,188 | A | | 3/1996 | Fukuoka | |
| 5,927,240 | A | * | 7/1999 | Maxon | 123/179.3 |
| 5,957,095 | A | * | 9/1999 | Kako | 123/90.15 |

FOREIGN PATENT DOCUMENTS

| | | | | |
|---|---|---|---|---|
| EP | 0 933 523 | A1 | | 8/1999 |
| JP | 2-145664 | U | | 12/1990 |
| JP | 5-036338 | A | | 2/1993 |
| JP | 7-077140 | A | | 3/1995 |
| JP | 9-68141 | | * | 3/1997 |
| JP | 9-189280 | | * | 7/1997 |
| JP | 9-228933 | A | | 9/1997 |
| JP | 11-82252 | | * | 3/1999 |
| JP | 11-270406 | A | | 10/1999 |
| JP | 11-351108 | A | | 12/1999 |
| JP | 2000-073813 | A | | 3/2000 |

* cited by examiner

*Primary Examiner*—Frank Vanaman
(74) *Attorney, Agent, or Firm*—Foley & Lardner LLP

(57) ABSTRACT

A starter mounting structure for a starter for cranking an engine (1) has a transmission case (2*a*) surrounding the transmission (2) and having an engine side end surface (200) facing an engine side. The engine block (1*b*) has a transmission side end surface (110, 120) facing a transmission side and partially overlapping the engine side end surface (200) of the transmission case (2*a*). An outer periphery (140) of the transmission side end surface (110, 120) of the engine block is partially equipped with a recess which extends on a crankshaft (5) side with respect to an inner periphery (240) of the engine side end surface (200) of the transmission case. An opening portion (13) is formed in correspondence with the recess. The starter mounting structure has a starter mounting member (9) closing the opening portion (13) and supporting the starter (8).

11 Claims, 10 Drawing Sheets

STARTER MOUNTING STRUCTURE

FIELD OF THE INVENTION

The present invention relates to a mounting structure for an engine starter.

BACKGROUND OF THE INVENTION

A starter of an engine is usually mounted near a connecting portion where the engine and transmission are connected together. A pinion gear provided in the starter meshes with a ring gear provided in the outer periphery of a drive plate or flywheel provided at an end of a crankshaft. The starter starts the engine by rotating the ring gear.

In an automatic transmission, a drive plate provided at an end of the crankshaft of an engine is fastened to a torque converter at an end of an input shaft of the transmission by means of bolts or the like. The fastening operation usually requires an operating space for it.

However, depending upon the layout of auxiliaries attached to the engine and transmission, there are limitations to the operating space. In particular, for effecting sealing between the engine and the automatic transmission, there is provided a rear plate dividing the engine from the automatic transmission. Thus, in performing an aligning operation between the bolt holes of the drive plate and torque converter, visual checking and the insertion of a fastening tool are rather difficult to perform. Thus, the efficiency of the fastening operation is rather low.

JP 11-270406 A, published in Japan in 1999, discloses a rear plate which has, apart from the opening for mounting the starter (by receiving a part of the starter), a cutout portion facing the portion where the drive plate and the torque converter are fastened together, the cutout portion being provided around the opening for mounting the starter. This cutout portion is used as a window for the fastening operation. Further, the cutout portion helps to enlarge the operating space, thereby facilitating the insertion of the tool.

However, the width of the cutout portion is limited depending on the size of the starter, and it is not satisfactory from the viewpoint of the visual checking in the bolt hole aligning operation.

SUMMARY OF THE INVENTION

Accordingly, it is an object of the present invention to secure a sufficient opening area to facilitate the operation of fastening the drive plate and the torque converter to each other.

In order to achieve the above object, this invention provides a starter mounting structure for a starter for cranking an engine connected to a transmission. The engine comprises a crankshaft for transmitting engine rotation to the transmission and an engine block constituting an engine main body. The starter mounting structure comprises a transmission case surrounding the transmission and having an engine side end surface facing an engine side; and the engine block which has a transmission side end surface facing a transmission side and partially overlapping the engine side end surface of the transmission case. An outer periphery of the transmission side end surface of the engine block is partially equipped with a recess which is recessed in a direction substantially perpendicular to an axial direction of the crankshaft and which extends on a crankshaft side with respect to an inner periphery of the engine side end surface of the transmission case. An opening portion is formed in correspondence with the recess and defined by the inner periphery of the engine side end surface of the transmission case and the outer periphery of the transmission side end surface of the engine block. The starter mounting structure further comprises a starter mounting member for closing the opening portion and supporting the starter.

The details as well as other features and advantages of this invention are set forth in the remainder of the specification and are shown in the accompanying drawings.

DETAILED DESCRIPTION OF THE PREFERRED EMBODIMENT

Figure 1:
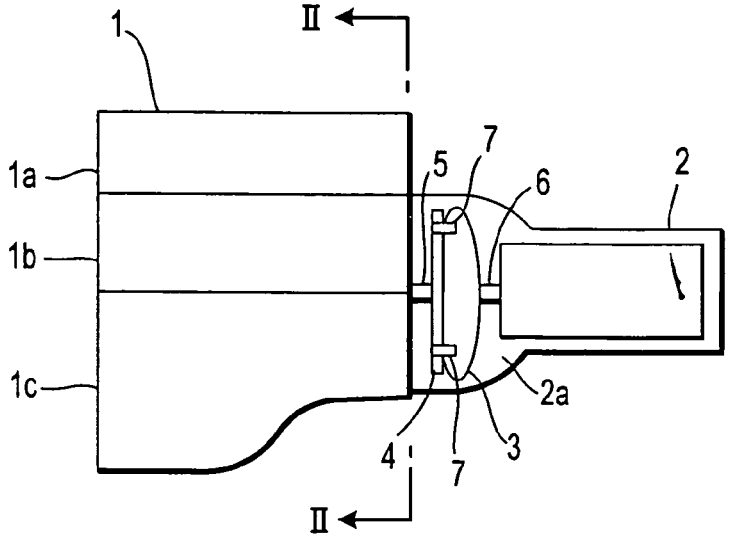
FIG. 1 is a schematic diagram showing an engine-transmission assembly according to an embodiment of the present invention, with a connection surface between an engine and transmission existing in the line II-II.

FIG. 1 is a diagram schematically showing the construction of an engine-transmission assembly.

An engine 1 is equipped with a cylinder head 1*a*, a cylinder block 1*b*, and an oil pan 1*c*. While a V-shaped engine is adopted as the engine 1 in this embodiment, it is naturally also possible for the engine 1 to be an in-line engine. The cylinder head 1*a* is mounted to the cylinder block 1*b*. The oil pan 1*c* is mounted to the cylinder block 1*b*. In this specification, the term "engine block" refers to a combination of the cylinder block 1*b* and the oil pan 1*c*. It is also possible for the cylinder block 1*b* and the oil pan 1*c* to be formed as an integral unit.

An automatic transmission 2 is connected to the engine 1. An end of a transmission case 2*a* and an end of the engine 1 are connected together by, for example, bolts (situated at the positions indicated by symbol 1*d* in FIG. 2). A portion 100 of a transmission side end surface (110, 120) of the engine block partially overlaps an engine side end surface 200 of the transmission case 2*a*. The portion 100 is indicated by the shaded portion in FIG. 2. A drive plate 4 provided at an end of a crankshaft 5 and a torque converter 3 provided on an input shaft 6 of the automatic transmission 2 are fastened to each other by means of bolts 7, etc., whereby the torque and rotation of the engine 1 is transmitted to the torque converter.

Figure 2:
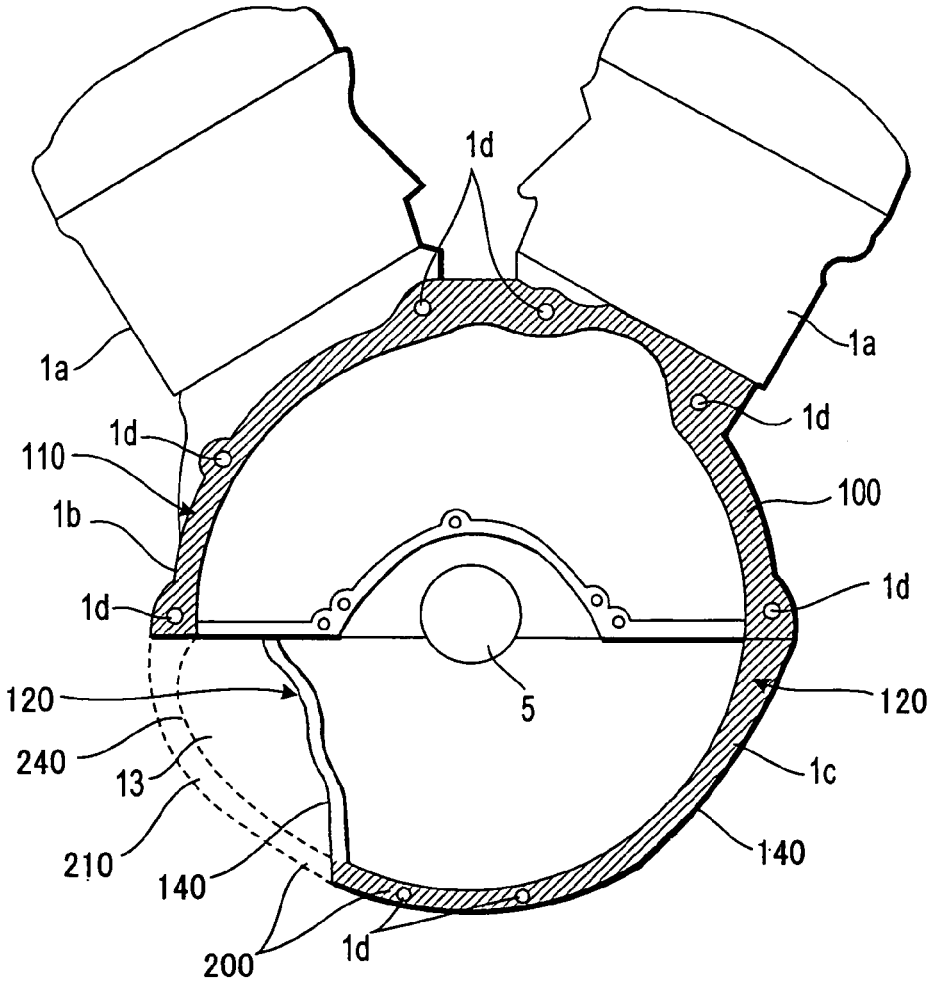
FIG. 2 is an end view, as seen from the transmission side, of the engine taken along the line II-II of FIG. 1, showing the connection surface of the engine to be connected to the transmission.

FIG. 2 is an end view of the engine 1 as seen from the automatic transmission side. On the top of the cylinder block 1*b*, there are provided two cylinder heads 1*a* at a predetermined angle. The oil pan 1*c* is connected to the lower side of the cylinder block 1*b*. The crankshaft 5 protrudes from the engine 1 toward the transmission side.

The shaded portion 100 of the end surface of the engine 1 shown in FIG. 2 constitutes the connection surface between the transmission case 2*a* and the engine block. In the drawing, the dashed lines indicate the engine side end surface 200 of the transmission case 2*a*.

The engine side end surface 200 of the transmission case 2*a* partially overlaps the transmission side end surface 110 of the cylinder block 1*b* and the transmission side end surface 120 of the oil pan 1*c* at the portion 100. However, in the left-hand side portion of the oil pan 1*c* as seen in the drawing, the engine side end surface 200 of the transmission case 2*a* does not overlap the transmission side end surface 120 of the oil pan 1*c* at a portion 210. An inner periphery 240 of the engine side end surface 200 and an outer periphery 140 of the transmission side end surface 120 of the oil pan 1*c* define an opening 13 (opening portion). That is, the outer periphery 140 of the transmission side end surface 120 of the oil pan 1*c* is partially equipped with a recess which is on the crankshaft side with respect to the inner periphery 240 of the engine side end surface 200 of the transmission case and which is recessed in a direction substantially perpendicular to the direction of the rotation axis of the crankshaft. As a result, the portion 210 of the engine side end surface 200 of the transmission case 2*a* is not covered with the end surface 120 of the oil pan 1*c*. The opening 13 is formed in correspondence with this recess. The opening 13 (opening portion) is used as a window for the operation of fastening the drive plate 4 and the torque converter 3 to each other.

In this embodiment, due to the construction described below, the opening 13 is closed after the fastening operation. Thus, there is no need to provide a rear plate as in the prior art. Accordingly, the area of the opening 13 for the fastening operation is substantially increased as compared with the prior-art technique, in which a cutout portion is provided around the starter mounting hole of the rear plate.

Next, the mounting of the starter 8 will be described with reference to FIGS. 3A through 6B.

Figure 3B:
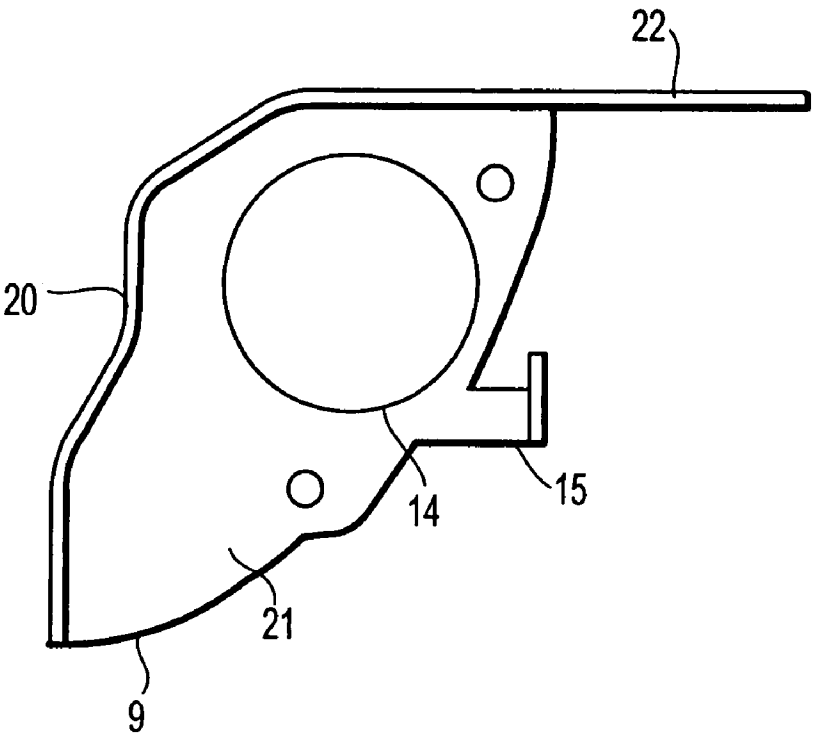
FIG. 3B is a front view of the mounting member.
Figure 3A:
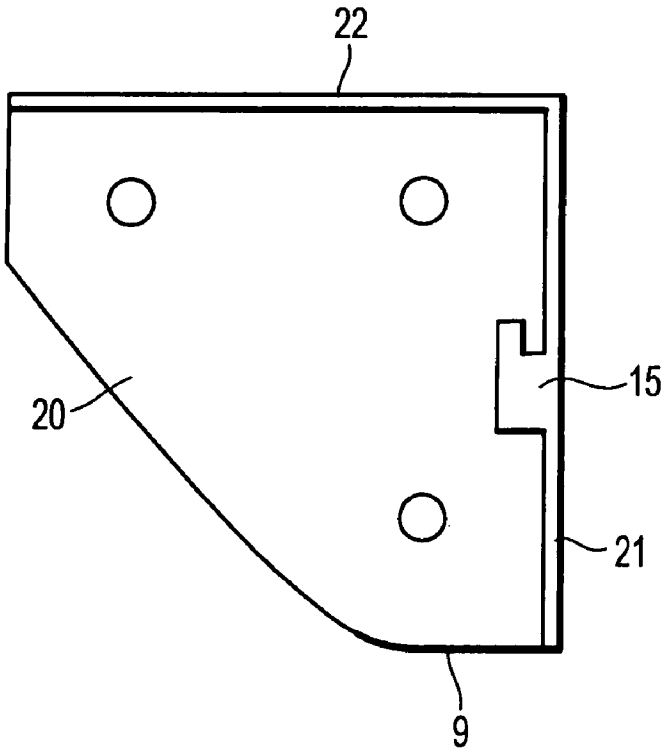
FIG. 3A is a side view of a mounting member.

FIGS. 3A and 3B are a side view and a front view, respectively, of a starter mounting member 9. An engine side mounting plate 20 is fixed to the cylinder block 1*b* or the oil pan 1*c* by means of bolts or the like. A transmission side mounting plate 21 perpendicular to the engine side mounting plate 20 is fixed to the transmission case 2*a* by means of bolts or the like.

The transmission side mounting plate 21 is substantially of the same configuration as the opening 13, with its contour being such that it completely closes the opening 13. When seen from above, a top plate 22 of the starter mounting member 9 has a configuration such that it completely hides a starter main body 8*b* and a switch portion 8*a*. The transmission side mounting plate 21 is equipped with a starter mounting hole 14 which is closed by mounting the starter 8 as described below.

The starter mounting member 9 is equipped with a harness fixing portion 15. When the starter 8 is fixed, the harness fixing portion 15 fixes the harness of the starter 8 so that no play may be allowed for the harness. For example, the harness fixing portion 15 is formed as a protrusion, and a recessed insertion portion corresponding to the protrusion is provided in the harness connector, whereby the harness is secured in position. Due to this arrangement, it is possible to reduce the number of components as compared with the case in which a component for fixing the harness is separately provided and fixed by a bolt.

Figure 4B:
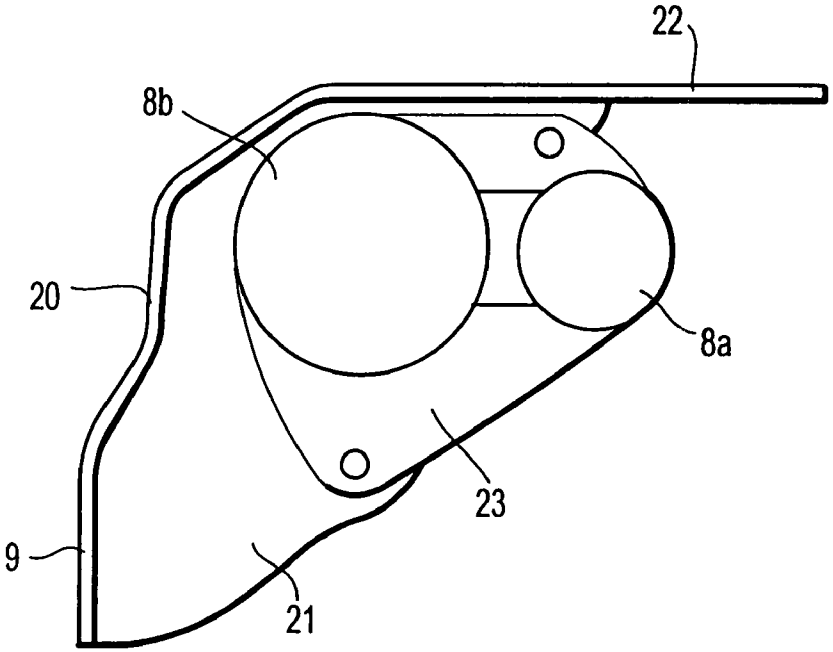
FIG. 4B is a front view of the mounting member with the starter fixed thereto.
Figure 4A:
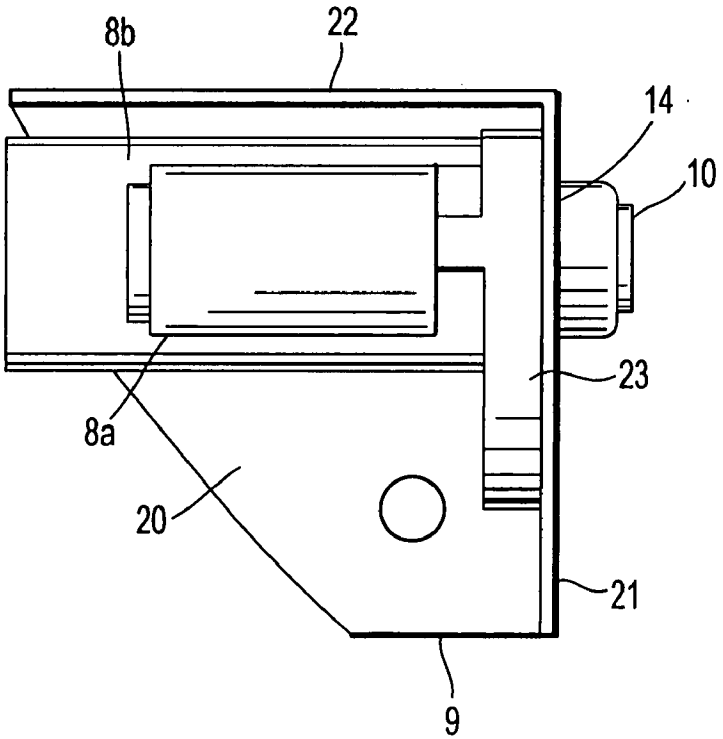
FIG. 4A is a side view of the mounting member with a starter fixed thereto.

FIGS. 4A and 4B are a side view and a front view, respectively, of the starter mounting member 9 with the starter 8 fixed thereto.

The starter 8 is equipped with the starter main body 8*b* and the switch portion 8*a*. A pinion gear 10 is provided at one end of the starter main body 8*b*. In the vicinity of the pinion gear 10 of the starter main body 8*b*, the starter 8 is equipped with a flange portion 23 for fixing the starter 8 to the starter mounting member 9. The pinion gear 10 protrudes on the opposite side of the switch portion 8*a* with respect to the flange portion 23. The flange portion 23 of the starter 8 is fixed to the starter mounting member 9, with the pinion gear 10 protruding from the starter mounting hole 14.

Figure 5:
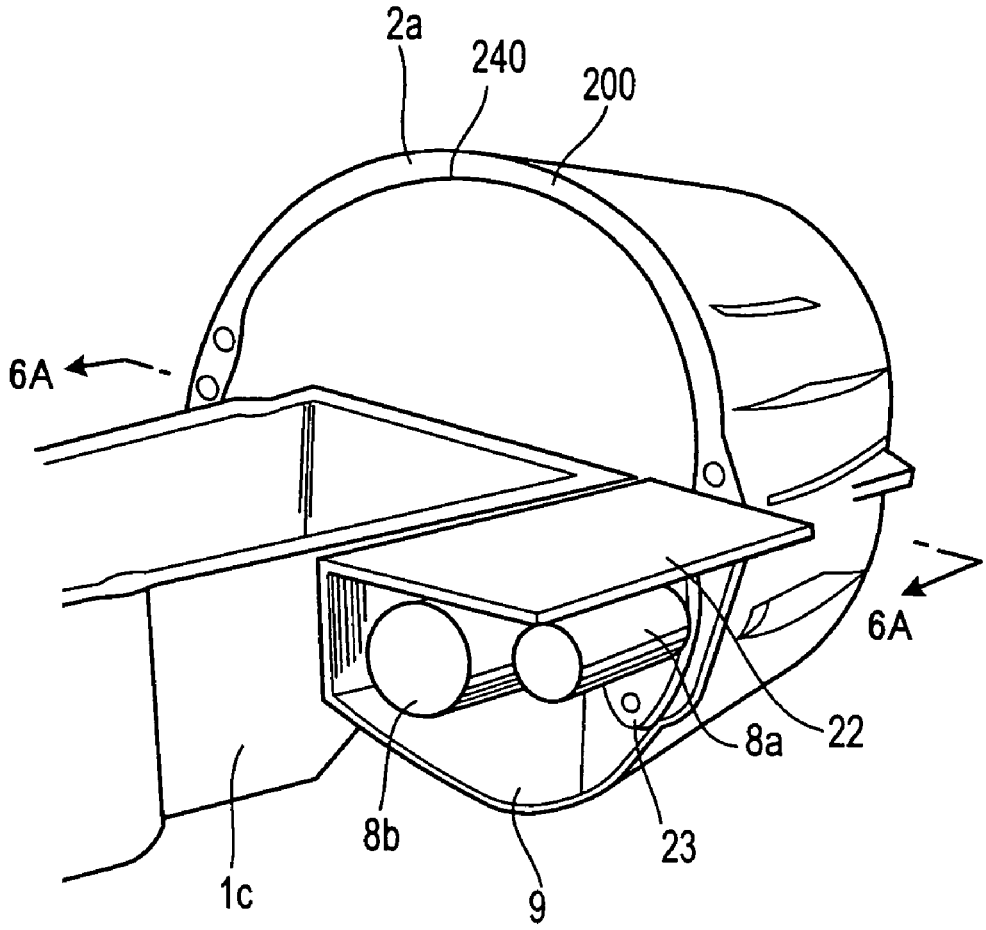
FIG. 5 is a perspective view of the engine-transmission assembly, with a cylinder head and a cylinder block omitted.
Figure 6A:
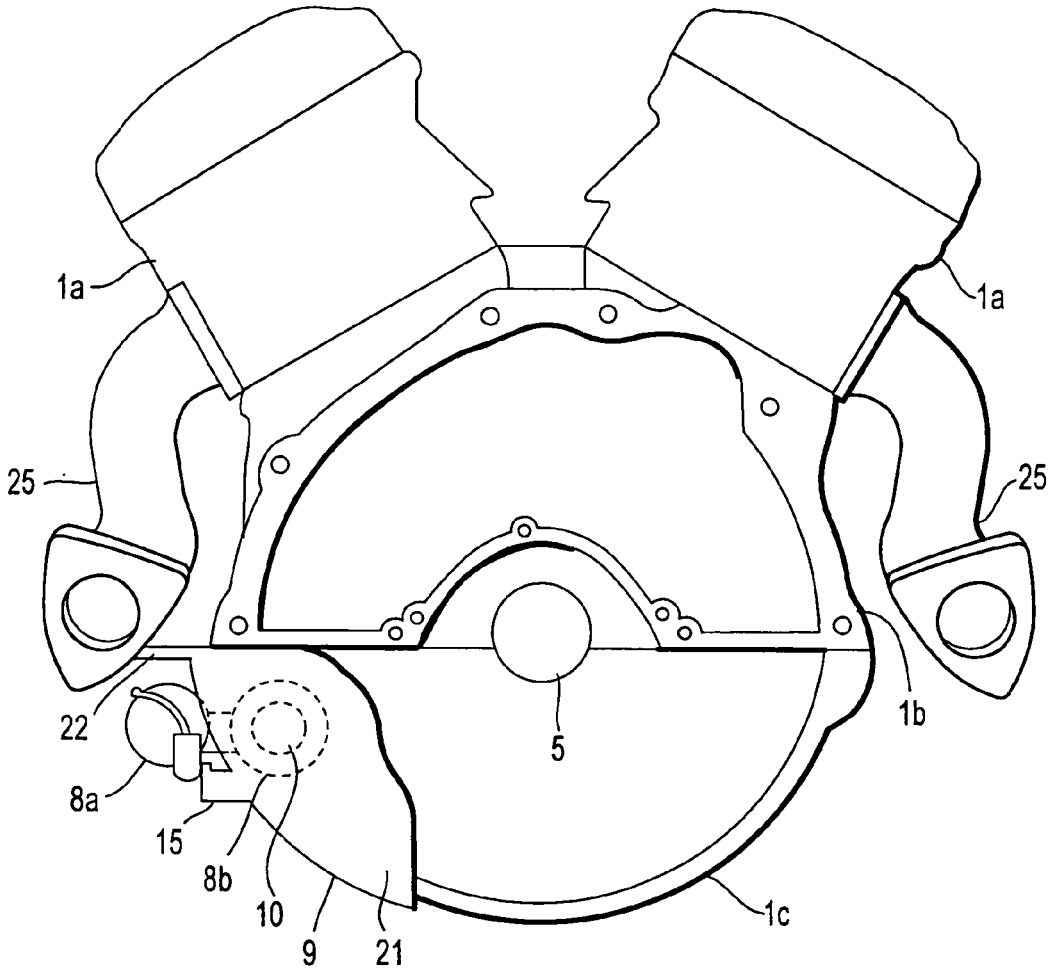
FIG. 6A is an end view, as seen from the transmission side, of the engine taken along the line 6A-6A of FIG. 5, showing the connection surface between the engine and the automatic transmission.
Figure 6B:
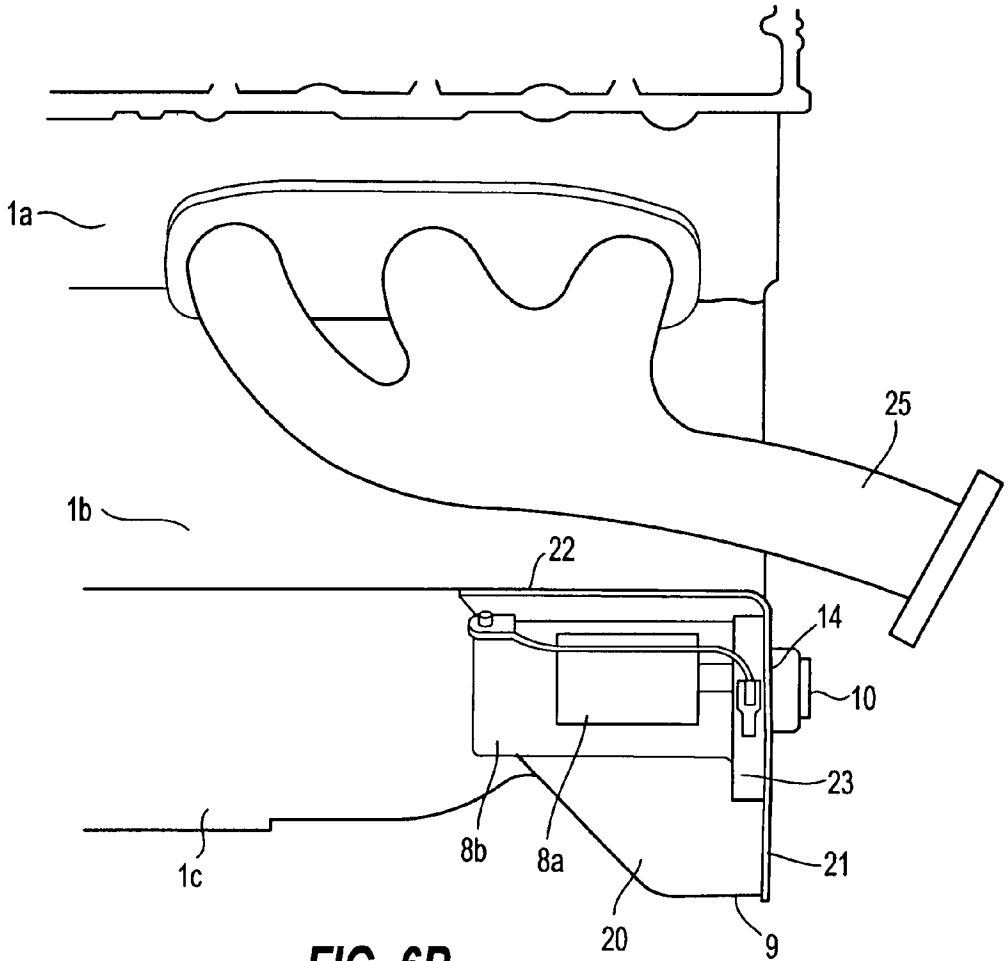
FIG. 6B is a side view of the engine shown in FIG. 5.

FIG. 5 shows how the starter mounting member 9 supporting the starter 8 is mounted to the engine 1. In FIG. 5, the cylinder block 1*b* is omitted. FIGS. 6A and 6B are a front sectional view and a partial side view, respectively, of the structure of FIG. 5.

The starter mounting member 9 is mounted to the engine 1 such that the transmission side mounting plate 21 closes the opening 13. At this time, the pinion gear 10 protrudes toward the transmission side from the transmission side mounting plate 21. When the engine 1 is to be started, the pinion gear 10 of the starter main body 8*b* extends in the direction of the rotation axis thereof to be meshed with a ring gear provided in the outer periphery of the drive plate 4. By causing the pinion gear 10 to rotate the drive plate 4, the starter 8 starts the engine 1. After the engine 1 has been started, the pinion gear 10 is contracted, and ceases to be engaged with the ring gear.

In the state in which the starter 8 is thus supported by the starter mounting member 9, the starter mounting member 9 is fixed to the engine 1 and the transmission case 2*a*. Thus, the starter can be mounted at various mounting positions solely by changing the configuration of the starter mounting member 9 without having to change the configuration of the flange portion 23 of the starter 8.

When the model of vehicle in which the engine 1 and the transmission 2 are mounted is different, the configuration and routing of the exhaust manifold 25, etc. are also different, thus necessitating a change in the position of the starter 8. In this regard, it has conventionally been necessary to prepare starters of different flange configurations and rear plates for different vehicles. In some cases, it has been even necessary to change the configurations of the oil pan 1*c*, the transmission case 2*a*, etc. In contrast, in this embodiment, as long as the mounting position for the starter 8 is within the range of the opening 13, application of the same construction to various vehicle models is possible by changing the configuration of the starter mounting member 9. In this embodiment, it is possible to use the starter 8 and the transmission case 2*a* of fixed configurations for various vehicle models.

Regarding the mounting position for the starter 8, as in the case of a crank angle sensor 26 described below, the starter 8 cannot be arranged at a low position of the oil pan 1*c* due to limitations in terms of minimum ground clearance, etc. Thus, the mounting position for the starter 8 is close to an exhaust manifold 25. In order to prevent the starter 8 from being heated by the heat of the exhaust manifold 25, there has conventionally been used a separate heat insulating plate prepared by press working. In contrast, in this embodiment, the top plate 22 of the starter mounting member 9 extends to isolate the starter 8 and the exhaust manifold 25 from each other, thus functioning as a heat insulating plate, whereby there is no need to prepare a separate heat insulating plate, which leads to a reduction in the number of parts and in cost.

The starter mounting member 9 further functions as a gusset plate (reinforcing member) having three sides: the engine side mounting plate 20, the transmission side mounting plate 21, and the top plate 22. Thus, it is possible to realize both a reduction in the number of parts and reinforcement of the connection between the oil pan 1*c* (or the engine 1) and the transmission 2.

Figure 9A:
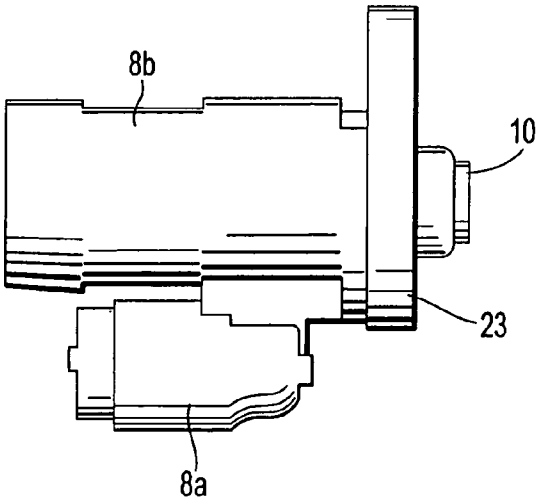
FIG. 9A is a top view of the starter mounting member with the starter fixed thereto, showing an example in which the starter mounting member is provided integrally with a starter flange portion.
Figure 9B:
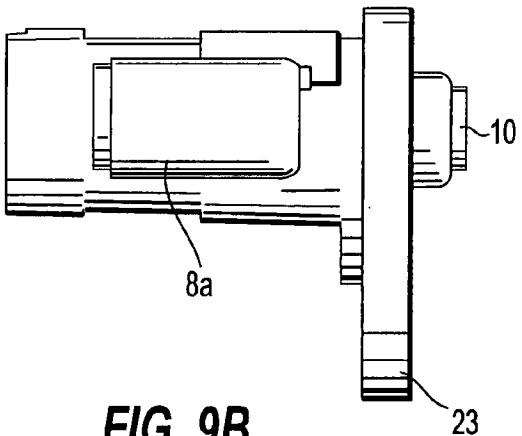
FIG. 9B is a side view of the starter mounting member with the starter fixed thereto, showing an example in which the starter mounting member is provided integrally with the starter flange portion.
Figure 9C:
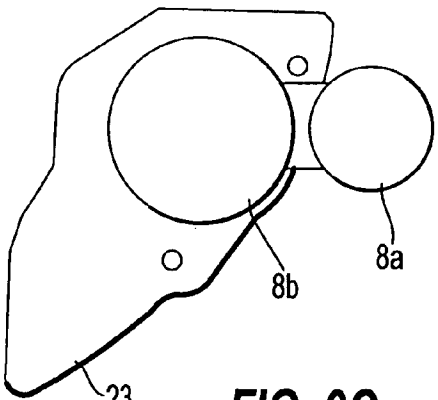
FIG. 9C is a front view of the starter mounting member with the starter fixed thereto, showing an example in which the starter mounting member is provided integrally with the starter flange portion.

Further, as shown in FIGS. 9A through 9C, the starter mounting member 9 may be formed integrally with the flange portion 23 of the starter 8. In this case, it is possible to achieve a reduction in the number of parts because the flange portion 23 serves as a starter mounting member. FIG. 9A is a top view of the starter; FIG. 9B is a side view of the starter; and FIG. 9C is a front view of the starter.

Next, the mounting position for the crank angle sensor 26 will be discussed with reference to FIGS. 7A and 7B. The crank angle sensor 26 is a sensor for detecting the requisite crank angle for determining the timing for ignition and the timing for fuel injection. For example, the crank angle sensor 26 reads the rotating position of a signal plate 41 provided in the outer periphery of the drive plate 4 and sends a detection signal to an engine control unit. Thus, the crank angle sensor 26 must naturally be provided at a position facing the drive plate 4.

Figure 7A:
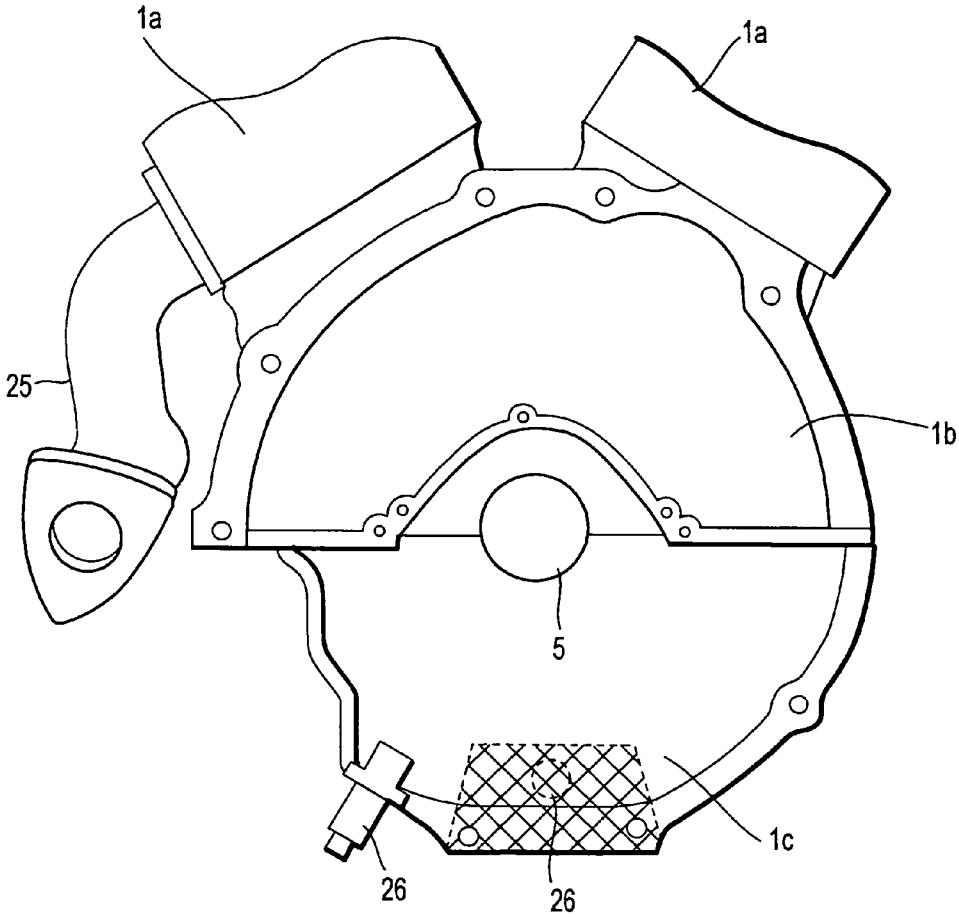
FIG. 7A is an end view of the engine, as seen from the transmission side, showing a crank angle sensor mounting position on the connection surface of the engine to be connected to the automatic transmission.
Figure 7B:
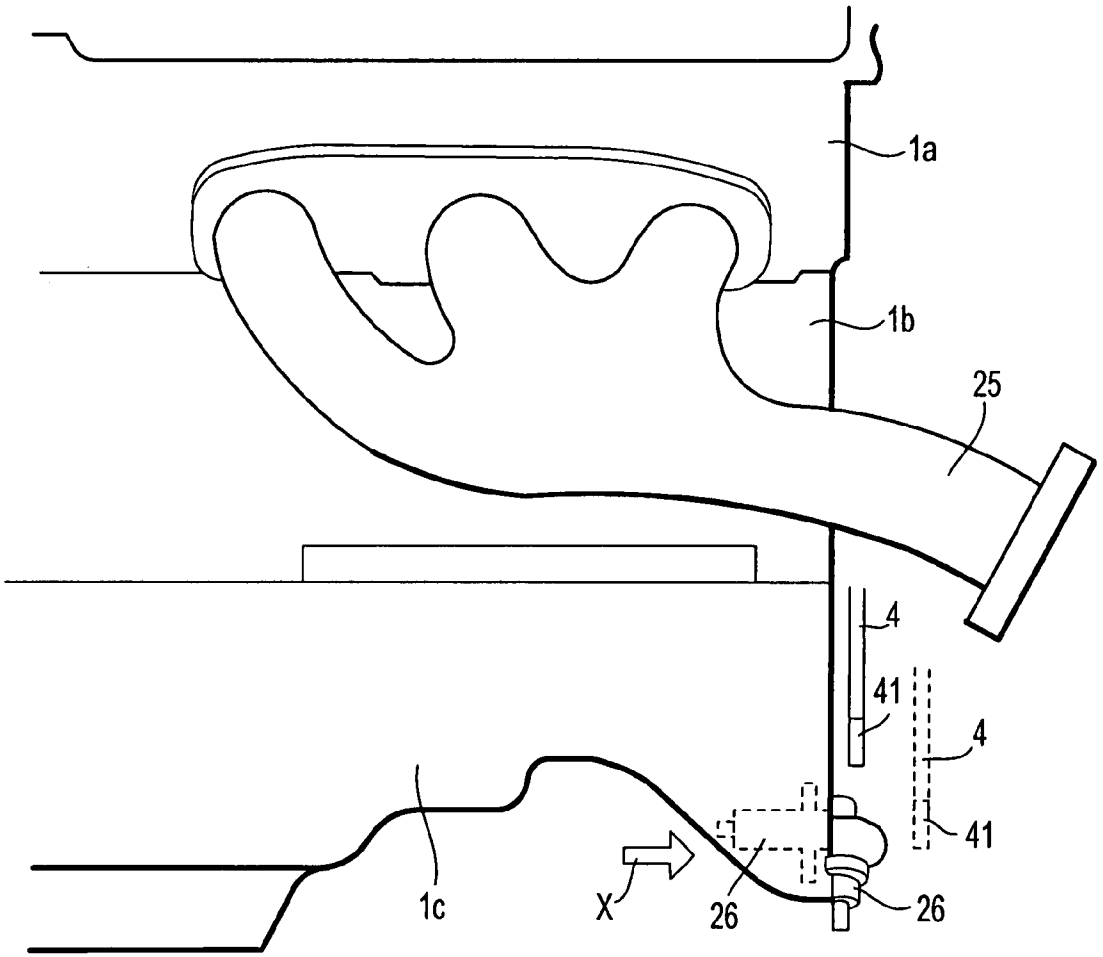
FIG. 7B is a side view of the engine, showing the crank angle sensor mounting position.

FIG. 7A is a schematic view of the end surface of the engine 1 as seen from the transmission 2 side, and FIG. 7B is a schematic side view of the engine 1.

The mounting position for the crank angle sensor 26 indicated by the solid lines in the drawings is a mounting position that is generally adopted at present. The mounting position for the crank angle sensor 26 indicated by the dashed lines is an example of the mounting position in this embodiment.

In the prior art, apart from the opening 13, an opening may be provided in a portion of the transmission side end surface 120 of the oil pan 1*c* (the cross-hatched portion in FIG. 7A). That is, an opening is formed by recessing the contour of the oil pan 1*c* toward the crankshaft. A rear plate corresponding to the opening is provided in such a manner that the rear plate can be separated from the remaining portion. In performing the attachment/detachment of the engine 1 to/from the transmission 2, the above-mentioned rear plate allowing separation is removed, and a tool is inserted in the direction of the arrow X in FIG. 7B, whereby the operation of attaching/detaching the drive plate 4 to/from the torque converter 3 is conducted.

Thus, in the prior art, the crank angle sensor 26 must be provided at a position (outside the cross-hatched portion) where it does not interfere with the operational efficiency in fastening. In view of this, as indicated by the solid lines in FIGS. 7A and 7B, the crank angle sensor 26 is arranged near the contour of the connecting portion between the transmission 2 and the engine 1 so as to face the crankshaft 5. Thus, the crank angle sensor 26 protrudes downwards from the contour of the engine 1 (oil pan 1*c*) and the transmission 2 (transmission case 2*a*). In FIG. 7B, the drive plate 4 and the signal plate 41 corresponding to the crank angle sensor 26 of the prior art are indicated by solid lines. While it is advantageous to mount the engine 1 at a low position from the viewpoint of vehicle stability, it is rather difficult, due to the downward protrusion of the crank angle sensor 26, to lower the mounting position, with the crank angle sensor at the position indicated by the solid lines.

In this embodiment, in contrast, the operation of fastening the torque converter 3 and the drive plate 4 is conducted in the opening 13, which is the mounting portion for the starter 8. Thus, there is no need to secure the cross-hatched portion as the operating space. As indicated by the dashed lines in FIGS. 7A and 7B, the crank angle sensor 26 is arranged in the cross-hatched portion so as to be substantially parallel to the rotation axis of the crankshaft 5. The crank angle sensor is embedded in the oil pan 1*c* so as not to outwardly protrude from the outer periphery of the transmission case 2*a*, whereby the mounting position for the engine 1 is not restricted by the crank angle sensor 26, which means it is possible to lower the mounting position for the engine as compared with the prior art. The drive plate 4 and the signal plate 41 corresponding to the crank angle sensor 26 of this embodiment are indicated by dashed lines.

When the crank angle sensor 26 is mounted at the above-mentioned position, there is no fear of the crank angle sensor 26 interfering with the starter mounting member 9. In contrast to the prior-art technique, there is no need to change the mounting position for the crank angle sensor 26 when the mounting position for the starter 8 is changed. Thus, it is possible to make the oil pan 1*c* a component common to different vehicle models.

Figure 8:
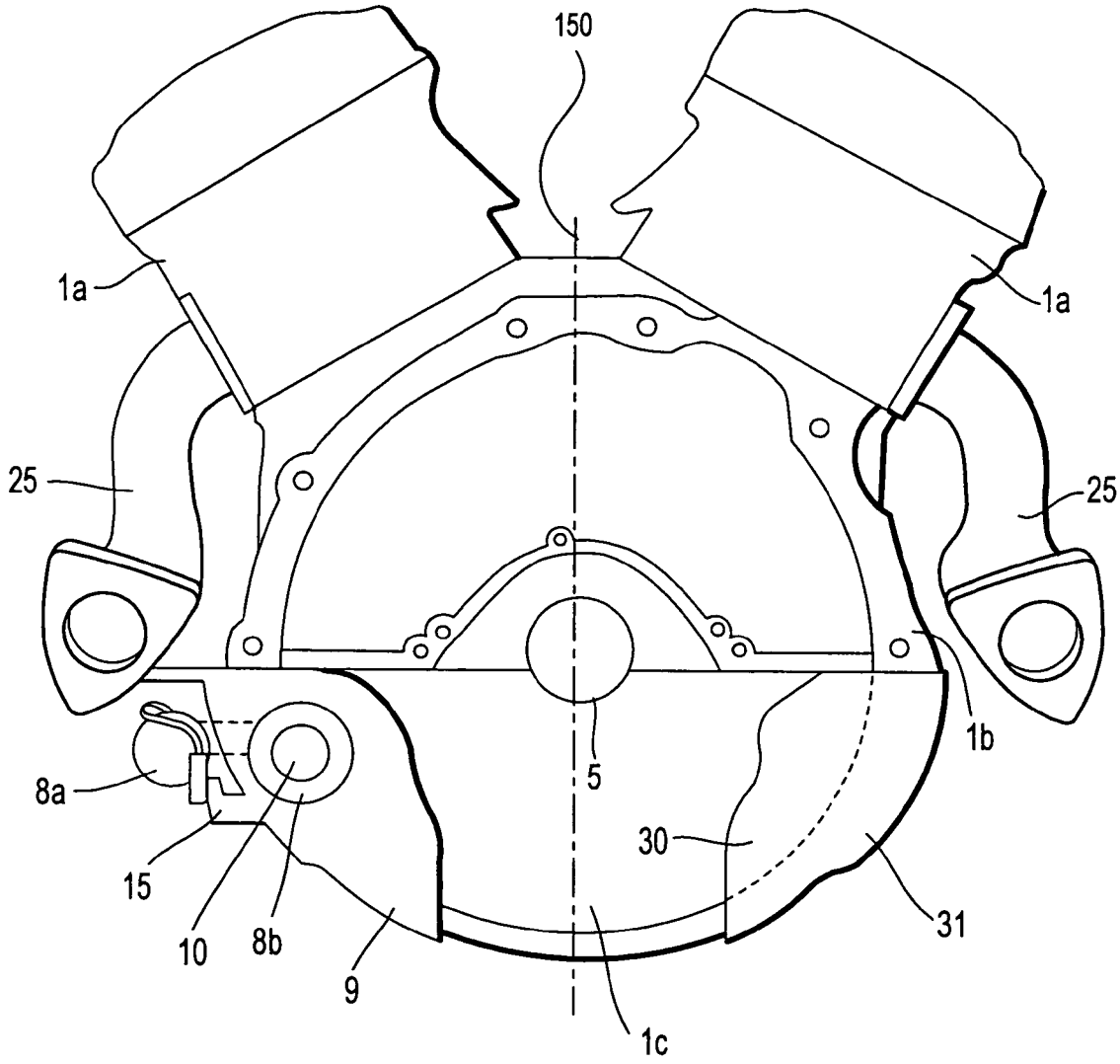
FIG. 8 is an end view of the engine, as seen from the transmission side, with a plurality of openings in the connection surface between the transmission and the engine being closed with a closing plate and the starter mounting plate.

Instead of providing only one opening 13, it is also possible to provide a plurality of such openings. For example, as shown in FIG. 8, it is possible to provide the (first) opening 13 and a second opening 30 in a substantially symmetrical arrangement with respect to the vertical center plane 150 of the connecting portion between the engine 1 and the transmission 2. Just as the opening 13 is closed by the starter mounting member 9, the opening 30 is closed by a closing plate 31.

Due to the provision of the opening 13 and 30 respectively on both sides of the engine 1, the starter mounting member of this embodiment is applicable to both a so-called left-hand drive car with the driver's seat on the left-hand side and a so-called right-hand drive car with the driver's seat on the right-hand side. In FIG. 8, the position where the steering shaft (not shown) passes is on the right-hand side with respect to the engine 1, so that the starter 8 does not hinder the passing of the steering shaft. In the case in which the position where the steering shaft (not shown) passes is on the left-hand side with respect to the engine, a mounting hole for the starter 8 is provided in the closing plate 31, and a closing plate 32 is used instead of the starter mounting member 9 on the left-hand side. In this way, it is possible provide the starter 8 on the right-hand side so as to be off the steering shaft disposed on the left-hand side.

As compared with the case in which there is only one opening 13, when a plurality of openings 13 and 30 are provided, the degree of freedom in terms of the mounting position for the starter 8 increases through the proper selective use of the starter mounting member 9 and the closing plates 31 and 32.

Since the starter mounting member 9 and the closing plate 31 are mounted respectively to both sides of the oil pan 1*c*, it is possible to achieve an improvement in terms of the reinforcement of the oil pan 1*c* as compared with the case in which only the starter mounting member 9 is mounted.

To enhance the sealing property of the starter mounting member 9 and the closing plates 31 and 32, it is possible to arrange sponge, rubber, or the like on the surface of the transmission side mounting plate 21 coming into contact with the transmission case 2*a*.

Although in the above-described embodiment no rear plate exists in the connecting portion between the engine 1 and the transmission 2, there may be used rear plates configured so as to completely open the openings 13 and 30.

Further, the effects of this embodiment, i.e., the fact that a change in the mounting position for the starter 8 can be coped with solely by changing the starter mounting member 9 and the closing plates 31 and 32, thus enabling the starter 8 to be used as a common component, and the fact that there is no need to provide a separate heat insulating plate, can also be obtained when this embodiment is applied to a manual transmission.

The entire contents of Japanese Patent Application P2003-159196 (filed Jun. 4, 2003) are incorporated herein by reference.

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

What is claimed is:

1. A starter mounting structure for a starter for cranking an engine connected to a transmission, the engine comprising a crankshaft for transmitting engine rotation to the transmission and an engine block constituting an engine main body, the starter mounting structure comprising:

a transmission case surrounding the transmission and having an engine side end surface facing an engine side;

the engine block which has a transmission side end surface facing a transmission side and partially overlapping the engine side end surface of the transmission case, wherein an outer periphery of the transmission side end surface of the engine block is partially equipped with a recess which is recessed in a direction substantially perpendicular to an axial direction of the crankshaft and which extends on a crankshaft side with respect to an inner periphery of the engine side end surface of the transmission case;

an opening portion formed in correspondence with the recess and defined by the inner periphery of the engine side end surface of the transmission case and the outer periphery of the transmission side end surface of the engine block; and a starter mounting member for closing the opening portion and supporting the starter;

wherein the starter mounting member comprises an engine side mounting plate fixed to the engine and a transmission side mounting plate fixed to the transmission case;

wherein the starter mounting member functions as a reinforcing member reinforcing connection between the engine block and the transmission case, and wherein the starter mounting member comprises plates on three sides including the engine side mounting plate fixed to the engine, the transmission side mounting plate fixed to the transmission case, and a top plate for isolating the starter and an exhaust manifold from each other.

2. The starter mounting structure according to claim 1, further comprising a harness fixing portion for fixing a harness of the starter to the starter mounting member.

3. The starter mounting structure according to claim 1, wherein the starter mounting member is integrated with a flange portion of the starter.

4. The starter mounting structure according to claim 1, wherein a seal member is provided on a surface of the starter mounting member coming into contact with the transmission.

5. The starter mounting structure according to claim 1, wherein the engine block comprises an oil pan, and wherein a crank angle sensor for detecting a rotating position of the crankshaft is embedded in the oil pan so as not to outwardly protrude from an outer periphery of the transmission case.

6. The starter mounting structure according to claim 1, further comprising a second opening portion, wherein the opening portions are arranged respectively on right-hand and left-hand sides with respect to the crankshaft, wherein the opening portion is closed by the starter mounting member and the second opening portion is closed by a closing member to which no starter is mounted.

7. An engine-transmission assembly comprising the starter mounting structure according to claim 1.

8. The starter mounting structure according to claim 1, wherein the top plate is configured to cover the starter.

9. The starter mounting structure according to claim 1, wherein the engine side mounting plate and the transmission side mounting plate are respectively fixed to the engine and the transmission case by bolts.

10. The starter mounting structure according to claim 1, wherein the starter mounting member is integral with the starter.

11. A starter mounting structure for a starter for cranking an engine connected to a transmission, the engine comprising a crankshaft for transmitting engine rotation to the transmission and an engine block constituting an engine main body, the starter mounting structure comprising:

a transmission case surrounding the transmission and having an engine side end surface facing an engine side;

the engine block which has a transmission side end surface facing a transmission side and partially overlapping the engine side end surface of the transmission case, wherein an outer periphery of the transmission side end surface of the engine block is partially equipped with a recess which is recessed in a direction substantially perpendicular to an axial direction of the crankshaft and which extends on a crankshaft side with respect to an inner periphery of the engine side end surface of the transmission case;

an opening portion formed in correspondence with the recess and defined by the inner periphery of the engine side end surface of the transmission case and the outer periphery of the transmission side end surface of the engine block; and a starter mounting member for closing the opening portion and supporting the starter;

wherein the starter mounting member comprises an engine side mounting plate fixed to the engine and a transmission side mounting plate fixed to the transmission case;

wherein the starter mounting member functions as a reinforcing member reinforcing connection between the engine block and the transmission case, wherein the starter mounting member comprises a heat insulating plate for the starter, and wherein the heat insulating plate extends between the starter and an exhaust manifold.

* * * * *